United States Patent [19]

Pedler

[11] 4,213,375

[45] Jul. 22, 1980

[54] FIREARM SAFETY DEVICE

[76] Inventor: Keith Pedler, Lot 1, Upper Gilston Rd., Gilston, Queensland 4211, Australia

[21] Appl. No.: 896,537

[22] Filed: Apr. 14, 1978

Related U.S. Application Data

[63] Continuation-in-part of Ser. No. 791,111, Apr. 26, 1977, abandoned.

[30] Foreign Application Priority Data

Jun. 24, 1977 [AU] Australia ..... PD0553

[51] Int. Cl.[2] ..... F41C 21/14

[52] U.S. Cl. ..... 89/31

[58] Field of Search ..... 42/1 R, 1 F; 89/1 R, 89/31; 102/65.2

[56] References Cited

U.S. PATENT DOCUMENTS

| | | | |
|---|---|---|---|
| 606,115 | 6/1898 | Benet | 42/1 R |
| 3,440,924 | 4/1969 | Sawyer | 89/14 E |
| 3,580,130 | 5/1971 | Arvidson et al. | 89/31 |
| 3,664,263 | 5/1972 | Driscoll | 42/1 F |
| 3,664,263 | 5/1972 | Driscoll | 102/65.2 |

FOREIGN PATENT DOCUMENTS

| | | | |
|---|---|---|---|
| 2201637 | 8/1973 | Fed. Rep. of Germany | 89/36 A |
| 604510 | 5/1926 | France | 102/65.2 |
| 12750 | of 1911 | United Kingdom | 42/1 R |

*Primary Examiner*—Stephen C. Bentley

*Attorney, Agent, or Firm*—Beveridge, De Grandi, Kline & Lunsford

[57] ABSTRACT

A safety devide for firearms is disclosed comprising a projectile absorption means which, when the device is located in operative position on the distal end of a firearm barrel, is held in the path of a discharged projectile to contain the projectile and arrest its motion. Securing means are provided for removably attaching the device to the end of the barrel. Embodiments are illustrated in which the projectile absorption means and securing means in some cases are rigidly connected while in others are connected by means providing limited relative movement between these components.

31 Claims, 16 Drawing Figures

FIREARM SAFETY DEVICE

This application is a continuation-in-part of U.S. patent application Ser. No. 791,111, filed Apr. 26, 1977, now abandoned.

An ever-present danger associated with the use of firearms is the possibility that the firearm might be accidentally discharged in such a way as to cause death or serious injury, particularly to children. It is an object of the present invention to provide a safety device which can be applied to the barrel of a firearm when not in use so as to prevent serious injury if the instrument is accidentally discharged.

According to the invention there is provided a safety device for firearms comprising:

a projectile absorption means which, when said device is located in operative position on a firearm barrel, is held in the path of a discharged projectile to contain said projectile and arrest the motion thereof; and securing means for removably attaching said device to the distal end of said firearm barrel.

Preferably, the projectile absorption means is not rigidly attached to the securing means and limited relative movement between these components is permitted to provide increased energy dissipation.

Preferred embodiments of the invention will now be described with reference to the accompanying drawings in which.

Figure 1:
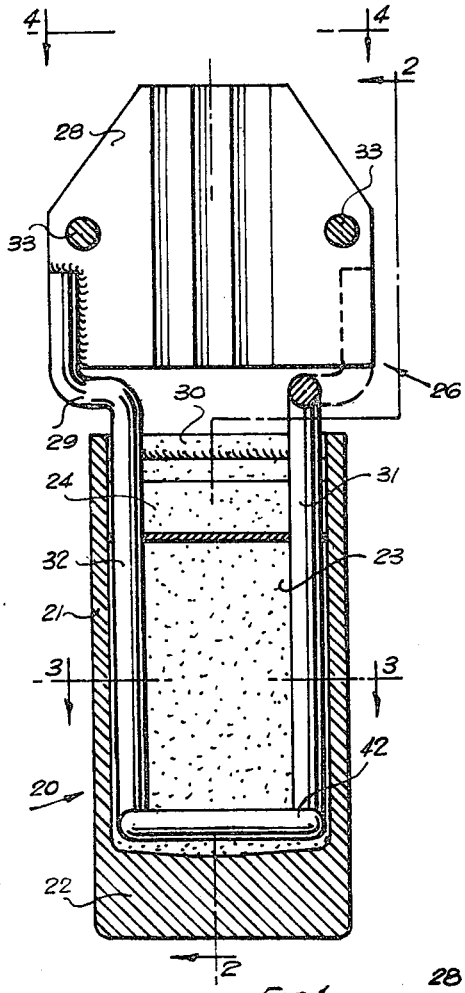
FIG. 1 is a sectional side elevation of one embodiment of a safety device according to the invention.
Figure 2:
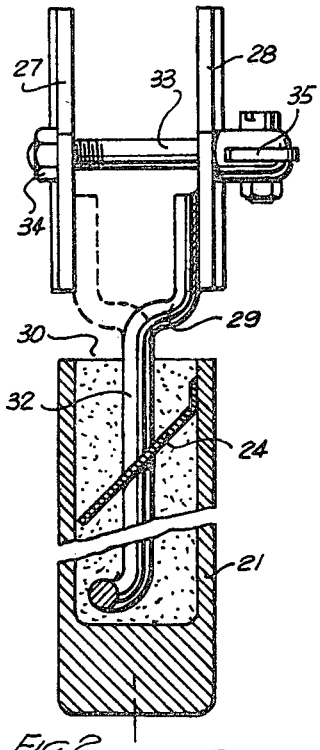
FIG. 2 is a sectional view taken on line 2—2 of FIG. 1.
Figure 3:
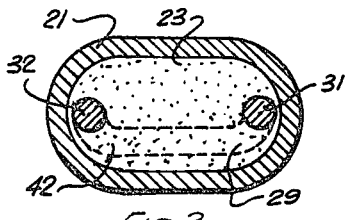
FIG. 3 is a sectional view taken on line 3—3 of FIG. 1.

Referring to FIGS. 1 to 4 of the drawings, the illustrated safety device includes a projectile absorption means 20 in the form of an oval sectioned cup 21 having its floor in the form of a massive block 22 and its interior filled with a relatively soft, projectile and energy absorbing medium 23. In this embodiment the cup is formed by a steel forging while the energy absorbing medium is a plastics material such as a vinyl plastisol with or without additional fibrous reinforcing means such as fibre glass. Foaming agents may also be included. Alternatively, the material 23 may be a soft metallic substance such as lead or a fibrous material such as wood depending upon the particular requirements. Generally however, the vinyl plastisol is preferred for its resilience and energy absorption characteristics as well as its ability to be cast in situ to enclose baffles such as the inclined plate 24 or other means to promote the arrest and retention of a discharged projectile. The walls of the cup 21 may, if desired, also be provided with passage means to facilitate the escape of high pressure propellant gases. The outer surface of the device is preferably provided with a covering of suitable plastics material which serves to protect the device and reduce the danger of damage caused by impact with it.

The safety device is secured to the distal end of a firearm barrel by a securing means 26 consisting primarily of two traversely extending plates 27 and 28, each being secured to the end of one limb of a substantially U-shaped steel rod 29 which extends into the un-floored end 30 of the cup 21 and is embedded in the plastics material 23. The un-floored end of the cup 30 may be open as shown or closed by a baffle plate if additional energy absorbing capacity is required.

Figure 4:
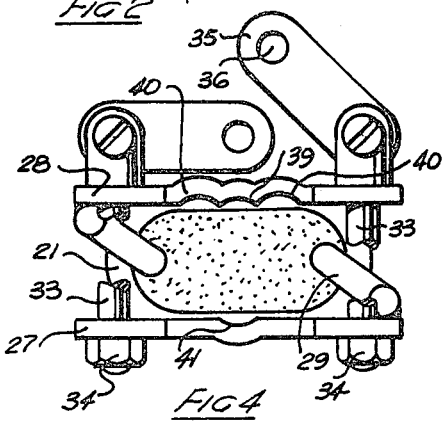
FIG. 4 is a view taken on line 4—4 of FIG. 1.

Each plate can rotate inwardly about the axis of its associated longitudinally extending limb of the rod 29 against the torsional springing imposed by the respective limb 31 or 32. Thus, to effect securement, two threaded pins 33 are provided, each engaging a captive nut 34 secured to plate 27. The pins 33 may be rotated by yoke mounted keys 35 which, when folded inwardly as shown in FIG. 4, bring a pair of holes 36 into register, thereby permitting a padlock or other locking means to be inserted therethrough to prevent unauthorised removal of the safety device from the firearm barrel.

As the pins 33 are rotated, the two plates 27 and 28 clamp against the firearm barrel and hold the device securely in position with the end of the barrel abutting or closely adjacent the plastics material 23. The inner surfaces of the plates are therefore preferably provided with a layer of soft plastics material to assist the frictional engagement of the barrel and prevent damage thereto. The plates themselves may be appropriately contoured as illustrated to assist in the engagement of the barrel. As shown in FIG. 4 plate 28 is provided with a central groove 39 located between two parallel outer grooves 40. In the case of single barrel firearms, the barrel located between the central groove 39 and a corresponding groove 41 on the opposite plate 27, while double barrels are secured between the two outer grooves 40 and the opposed face of plate 27.

The above described securing arrangement is also beneficial to the energy absorbing function of the safety device. When a firearm is discharged into the device, the plastics material 23 bearing against the rod 29, particularly at its crotch portion 42, acts as a spring which permits the absorption means to move a short distance away from the clamping plates, without causing the entire device to leave the firearm barrel. This short displacement of the absorption means from the end of the barrel also provides a gap which facilitates the escape of propellent gases in a situation where the end of the barrel was originally abutting the plastics material. Energy is also dissipated by friction between the material 23, the rod 29 and the interior of the cup 21 as well as by plastic deformation of the material and the cup itself.

Figure 5:
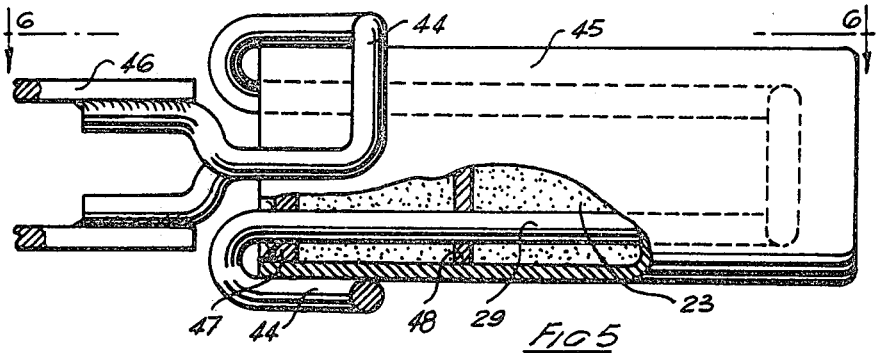
FIG. 5 is a partly sectioned side elevation of a second embodiment of the invention.
Figure 6:
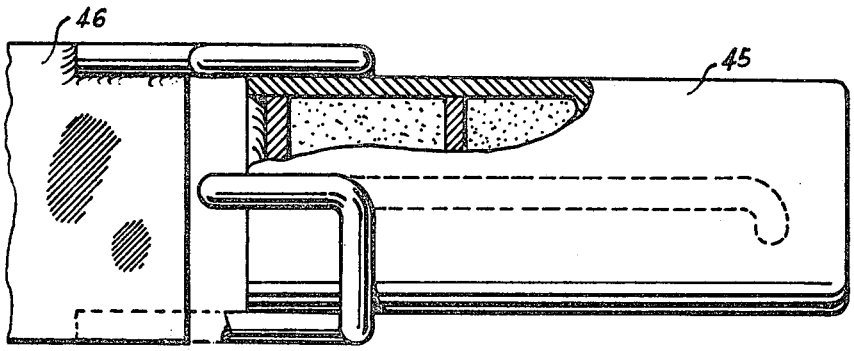
FIG. 6 is a view taken on line 6—6 of FIG. 5.
Figure 8:
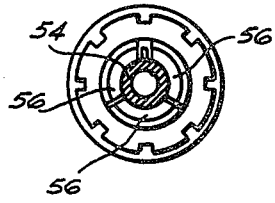
FIG. 8 is a view taken on line 8—8 of FIG. 7.

In order to provide additional energy absorbing capacity for higher energy firearms such as those using magnum cartridges, the exposed portions of the rod 29 may initially be provided with a twisted portion, part of which extends generally transversely of the barrel axis as shown in FIGS. 5 and 6. In this case, additional energy is absorbed in distorting and straightening the twisted portions 44 as the absorption means 45 moves away from its securing means 46. The absorption means in this second embodiment is circular in cross section and provided with two steel baffle plates 47 and 48. The baffle 47 is welded in position to close the un-floored end of the cup which may contain the same plastic material 23 as that of the first embodiment to absorb and retain the projectile and its fragments. Upon impact, the projectile passes completely through the baffle 47 and embeds itself with the casing.

Figure 7:
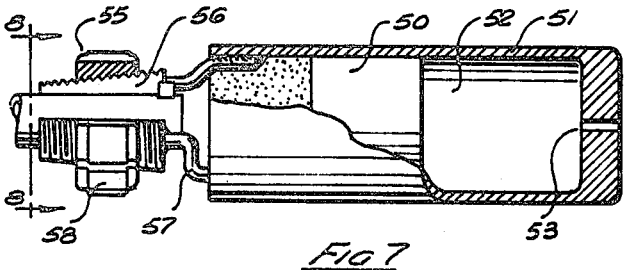
FIG. 7 is a partly sectioned side elevation of a third embodiment of the invention shown in operative position on a firearm barrel.

A third embodiment of the invention is shown in FIG. 7. In this case, the projectile absorption means includes a block 50 which, when impacted by a projectile, slides within a housing 51 against wall friction and pneumatic pressure built up ahead of it in chamber 52. The chamber 52 may be provided with one or more apertures 53 to permit controlled release of the pneumatic pressure. The block 50 may be of any suitable material such as lead or nylon. The housing 51 is secured to the firearm barrel 54 by an integral collet clamp 55 having angularly spaced, externally threaded and tapered gripping jaws 56 secured to the casing 51 by rods 57. Clamping is effected by a nut 58 threadedly engaged with the jaws such that, upon rotation, the jaws 56 are urged into clamping engagement with the barrel 54.

Figure 9:
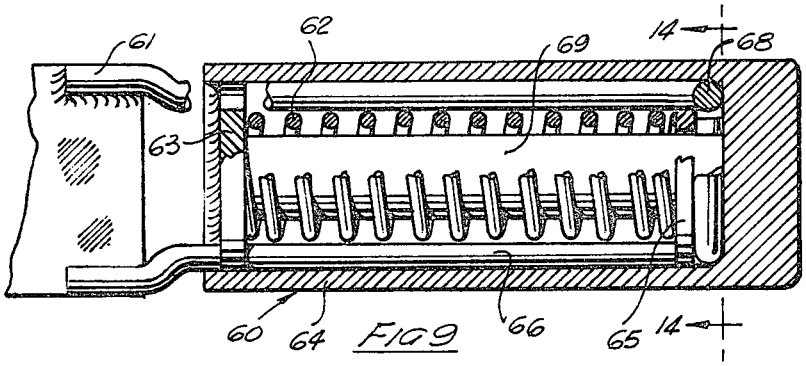
FIG. 9 is a sectional side elevation of a fourth embodiment of the invention.
Figure 14:
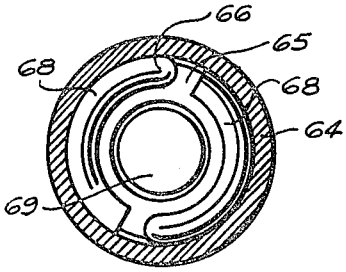
FIG. 14 is a view taken on line 14—14 of FIG. 9.

In a fourth embodiment of the invention illustrated in FIG. 9, the projectile absorption means 60 is coupled to the securing means 61 by a compression spring 62. The spring 62 extends between a baffle or abutment 63 on the cup 64 and a washer 65 bearing against the foot portions of two generally L-shaped extensions 66 projecting from the securing means. The foot portion 68 of each extension 66 is generally C-shaped when viewed in an axial direction as shown in FIG. 14 and permits a central absorption block 69 to move past the foot portions as the spring compresses and the cup moves relative to the securing means and the extensions 66.

Figure 10:
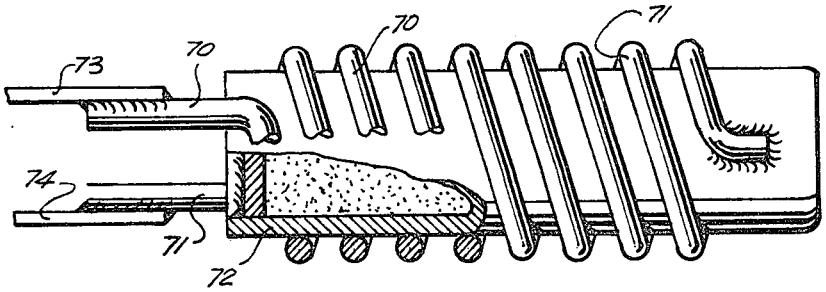
FIG. 10 is a partly sectioned side elevation of a fifth embodiment of the invention.

In a sixth embodiment illustrated in FIG. 10, a pair of tension springs 70 and 71 surround the cup 72 and connect it to a pair of clamping plates 73 and 74 respectively.

Figure 11:
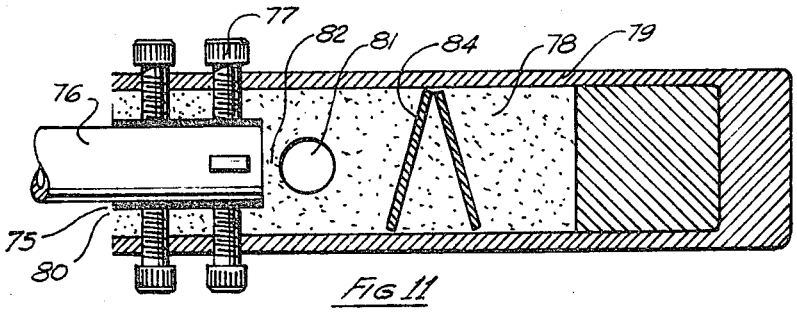
FIG. 11 is a sectional side elevation of a sixth embodiment of the invention.

The seventh embodiment of the invention as shown in FIG. 11 is a relatively simple device which clamps directly to the firearm barrel 76 by means of grub screws 77 acting against a protective wrapping of plastics material 78. The cup 79 is substantially filled with plastics material to define a recess 80 for receiving and locating the barrel and, preferably, a transverse passage 81 separated from the recess 80 by a thin wall 82. The wall 82 assists in the location of the device on the barrel and prevents the barrel from protruding into and blocking the transverse passage 81 which communicates with apertures formed in opposite side walls of the cup 79. The plastics material 78 also positions two steel baffle plates 84 which are inclined with respect to the axis of the barrel.

If a firearm is discharged with the safety device in position, the projectile first breaks through the thin wall 82 and then proceeds into the main body of the plastics material 78. It may be that the thin wall 82 would be punctured as a result of an increase in air pressure in front of the projectile as it advances along the barrel. In any event, the high pressure propellant gases following the projectile can move out of the safety device through the passage 81.

Tests carried out with a .22 calibre rifle fitted with a safety device as illustrated in FIG. 11 and described above showed that the device was capable of retaining the projectile without dislodgement from the end of the barrel.

Figure 12:
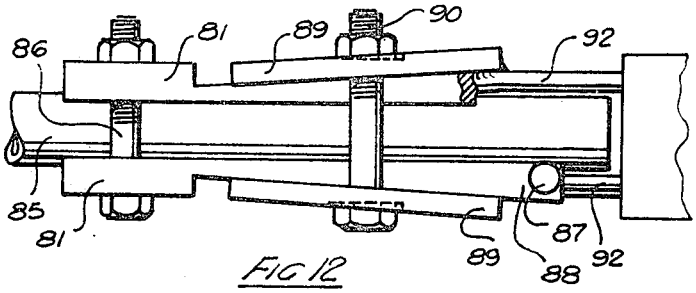
FIG. 12 is a sectional side elevation of a further securing means.
Figure 13:
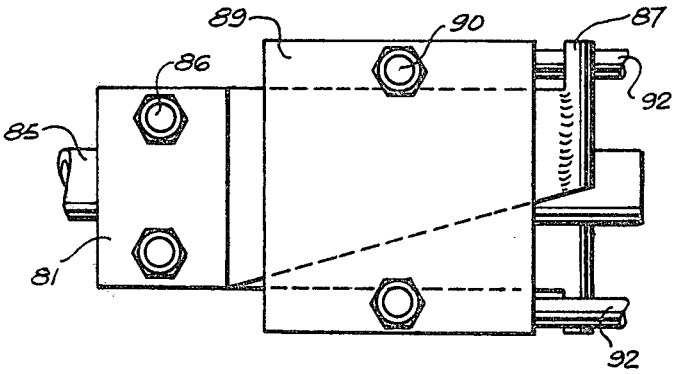
FIG. 13 is a cut away plan view of the clamping means shown in FIG. 12.

A modified securing means suitable for use with safety devices which permit some movement of the absorption means relative to the barrel is illustrated in FIGS. 12 and 13. In this clamp, the barrel 85 is gripped by two opposed wedging plates 81 which are secured by clamping bolts 86 and each provided with aligned longitudinal grooves to locate the barrel between them. Each of the plates is further provided with a projecting stop 87 and an inclined outer face 88 against which two outer plates 89 are clamped by bolts 90. The outer plates 89 are connected with the absorption means, for example by securement with the free ends 92 of a U-shaped rod similar to that of the embodiment illustrated in FIGS. 1 to 4.

When a projectile is discharged with the safety device secured by a clamp as presently illustrated, any movement of the outer plates in a direction away from the barrel causes them to ride up over the inclined outer surfaces 88 and further tighten the securing means against movement relative to the barrel. The extent of relative movement permitted the absorption means is limited by the stops 87 which lie in the path of the bolts 90 and thereby prevent them from moving past the end of the inner plates.

In other embodiments the securing means may lockingly engage the forward sight for formations specially provided on the barrel for this purpose.

Figure 15:
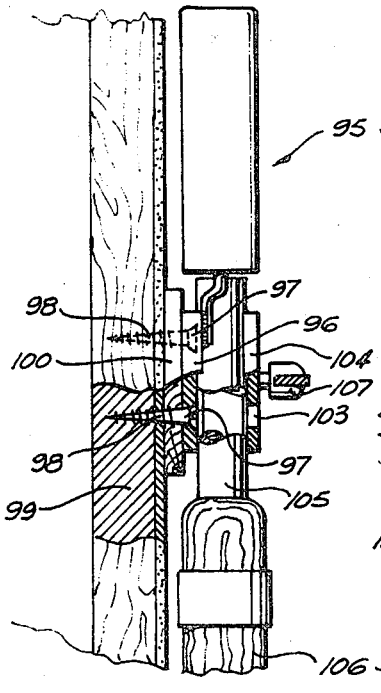
FIG. 15 is a partly sectioned side elevation of a seventh embodiment of the invention.
Figure 16:
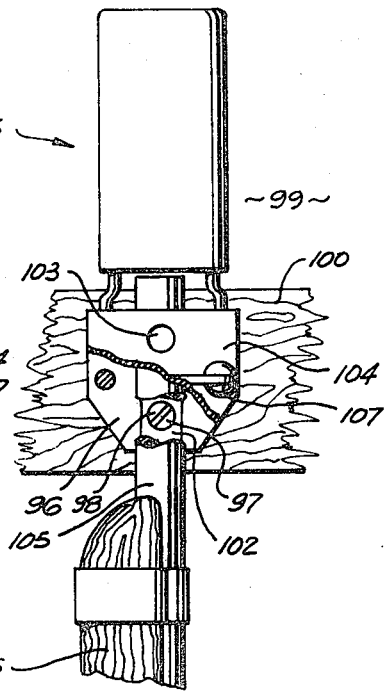
FIG. 16 is an end elevation of the embodiment shown in FIG. 15.

FIGS. 15 and 16 illustrate an embodiment of the invention adapted for locking a firearm to a fixture so as to prevent its unauthorised removal. In this security installation the safety device 95 may be otherwise identical to that illustrated in FIGS. 1 to 4 but one clamping plate 96 is now provided with two spaced holes 97 for receiving screws 98. These screws rigidly secure the device to a wall 99 through an intermediate strip 100 which spaces the device outwardly from the wall. The holes 97 are spaced along a groove 102 corresponding to the groove 41 of the first embodiment and arranged in register with two corresponding holes 103 formed in the opposite plate 104 for providing access to the screws 98 for effecting securement and removal of the device. The holes 97 are, however, so placed that access to the screws 98 is obstructed by the barrel 105 when the firearm 106 is locked in position. Thus, once the safety device is secured and locked to the firearm by a padlock or other locking means engaging the yoke mounted keys 107 as previously described, the firearm cannot readily be removed from the wall without releasing the locking means. In this way the invention can provide security in addition to safety.

Although the invention has been described with reference to specific examples, it will be appreciated by those skilled in the art that the invention may be embodied in many other forms.

I claim:

1. A safety device for firearms comprising:

securing means for removably attaching said device in an operative position on a firearm;

a cup having a floored end and an unfloored end;

a resilient plastic projectile absorbing medium in said cup;

a substantially U-shaped rod having its crotch position embedded within said projectile absorbing medium and its free ends attached to said securing means to connect said projectile absorbing medium and said cup to said securing means so that when said device is located in the operative position on a firearm the unfloored end of the cup and the open end of the firearm barrel are in mutual confrontation with said cup and projectile absorbing medium held in front of the firearm barrel in the path of a projectile discharged from the firearm barrel to safely contain such projectile and arrest the motion thereof, while permitting limited relative movement between said cup and projectile absorbing medium and said securing means on impact of a discharged projectile on said projectile absorbing medium.

2. A safety device as claimed in claim 1 in which said securing means comprises a pair of opposed spaced plates, each plate attached to a respective one of the free ends of said U-shaped rod, and loading means for clamping said plates about the barrel of a firearm with said device in the operative position on the firearm.

3. A safety device as claimed in claim 2, in which each free end of said U-shaped rod includes a twisted portion part of each twisted portion extending transversely of the axis of the firearm barrel when said device is located in the operative position on a firearm.

4. A safety device as claimed in claim 3 further comprising a baffle plate closing the un-floored end of said cup.

5. A safety device as claimed in claim 2 in which said loading means comprises a pair of screws, each screw including a hinged key member having a locking hole formed therein, said key members being capable of assuming an overlapping relationship with their respective locking holes in register for insertion of locking means therethrough.

6. A safety device as claimed in claim 5 further comprising a baffle plate closing the un-floored end of said cup.

7. A safety device as claimed in claim 1 in which each free end of said U-shaped rod includes a twisted portion, part of each twisted portion extending transversely of the axis of the firearm barrel when said device is located in the operative position on a firearm.

8. A safety device as claimed in claim 7 further comprising a baffle plate closing the un-floored end of said cup.

9. A safety device as claimed in claim 1 in which said resilient plastic material is a vinyl plastisol.

10. A safety device as claimed in claim 1 further comprising at least one baffle member enclosed within said resilient plastic material.

11. A safety device as claimed in claim 1 in which said resilient plastic material includes fibrous reinforcing means.

12. A device as claimed in claim 1 in which said securing means is adapted to attach said device to the distal end of the firearm barrel.

13. A device as claimed in claim 12 in which said securing means is adapted to attach said device to the distal end of the firearm barrel by applying clamping pressure to the barrel.

14. A device as claimed in claim 1 in which said closed forward end of said sleeve member is defined by a massive block of rigid material.

15. A device as claimed in claim 1 in which said closed forward end of said sleeve member is defined by a massive block of rigid material.

16. A safety device for firearms comprising:

a pair of opposed spaced plates;

loading means for clamping said plates about the barrel of a firearm to removably attach said device in an operative position on the firearm;

projectile absorption means which, when said device is located in the operative position on a firearm, is held in front of the firearm barrel in the path of a projectile discharged from the firearm barrel to safely contain such projectile and arrest the motion thereof; and connecting means connecting said projectile absorption means to said plates while permitting limited relative movement therebetween on impact of a discharged projectile on said absorption means.

17. A safety device as claimed in claim 16 in which one of said plates has three substantially parallel grooves on the face thereof facing the other of said plates, and said other of said plates has one groove on the face thereof facing said one of said plates and in register with the center one of said three parallel grooves, whereby said device may be accurately secured in the operative position on both single barrelled and double-barrelled firearms.

18. A safety device for firearms comprising:

securing means for removably attaching said device in an operative position on a firearm;

a cup having a floored end and an unfloored end;

a projectile absorbing medium in said cup;

a connecting member having a first portion attached to said securing means and a second portion embedded within said projectile absorbing medium to connect said projectile absorbing medium and said cup to said securing means so that when said device is located in the operative position on a firearm the unfloored end of the cup and the open end of the firearm barrel are in mutual confrontation with said cup and projectile absorbing medium held in front of the firearm barrel in the path of a projectile discharged from the firearm barrel to safely contain such projectile and arrest the motion thereof, while permitting limited relative movement between said cup and projectile absorbing medium and said securing means on impact of a discharged projectile on said projectile absorbing medium.

19. A safety device as claimed in claim 18 in which said projectile absorbing medium comprises a resilient plastic material.

20. A safety device as claimed in claim 19 in which said resilient plastic material is a vinyl plastisol.

21. A safety device as claimed in claim 19 in which said resilient plastic material includes fibrous reinforcing means.

22. A safety device as claimed in claim 19 further comprising at least one baffle member enclosed within said resilient plastic material.

23. A safety device as claimed in claim 18 in which said securing means comprises a pair of opposed spaced plates, each plate attached to said connecting means first end portion, and loading means for clamping said plates about the barrel of a firearm with said device in the operative position on the firearm.

24. A safety device as claimed in claim 23 in which said loading means comprises a pair of screws, each screw including a hinged key member having a locking hole formed therein, said key members being capable of assuming an overlapping relationship with their respective locking holes in register for insertion of locking means therethrough.

25. A safety device as claimed in claim 23 in which one of said plates has three substantially parallel grooves on the face thereof facing the other of said plates, and said other of said plates has one groove on the face thereof facing said one of said plates and in register with the center one of said three parallel grooves, whereby said device may be accurately secured in the operative position on both single barrelled and double-barrelled firearms.

26. A safety device as claimed in claim 18 in which said connecting member includes a twisted portion, part of said twisted portion extending transversely of the axis of the firearm barrel when said device is located in the operative position on a firearm.

27. A safety device as claimed in claim 18 further comprising a baffle plate closing the unfloored end of said cup.

28. A safety device as claimed in claim 18 in which said projectile absorbing medium comprises a soft metallic material.

29. A device as claimed in claim 18 in which said securing means is adapted to attach said device to the distal end of the firearm barrel.

30. A device as claimed in claim 29 in which said securing means is adapted to attach said device to the distal end of the firearm barrel by applying clamping pressure to the barrel.

31. A device as claimed in claim 18 in which said closed forward end of said sleeve member is defined by a massive block of rigid material.

* * * * *